US010907870B2

(12) United States Patent
Lambert et al.

(10) Patent No.: US 10,907,870 B2
(45) Date of Patent: Feb. 2, 2021

(54) MUFFLER FOR LUBRICANT SEPARATOR

(71) Applicants: Carrier Corporation, Palm Beach Gardens, FL (US); Francois Lambert, Neuville sur Saône (FR)

(72) Inventors: Francois Lambert, Neuville sur Saône (FR); Jin Liu, Fayetteville, NY (US); Damien Poux, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 28 days.

(21) Appl. No.: 16/461,077

(22) PCT Filed: Nov. 15, 2016

(86) PCT No.: PCT/IB2016/001782

§ 371 (c)(1),
(2) Date: May 15, 2019

(87) PCT Pub. No.: WO2018/091939

PCT Pub. Date: May 24, 2018

(65) Prior Publication Data

US 2019/0277547 A1 Sep. 12, 2019

(51) Int. Cl.
*F25B 43/02* (2006.01)
*F25B 31/00* (2006.01)

(52) U.S. Cl.
CPC ..... *F25B 43/02* (2013.01); *F25B 31/002* (2013.01); *F25B 2500/12* (2013.01)

(58) Field of Classification Search
CPC .. F04C 29/026; F25B 43/003; F25B 2500/13; F25B 2500/12; F25B 43/02
See application file for complete search history.

(56) References Cited

U.S. PATENT DOCUMENTS 3,070,977 A * 1/1963 Kimmel ..... F25B 43/02 62/473
5,214,937 A 6/1993 Henrichs et al.
(Continued)

FOREIGN PATENT DOCUMENTS

CA 1155400 10/1983
CN 2147356 Y 11/1993
(Continued)

OTHER PUBLICATIONS

International Search Report for International Application No. PCT/IB2016/001782; International Filing Date Nov. 15, 2016; dated Jul. 18, 2017; 4 Pages.
(Continued)

*Primary Examiner* — Cassey D Bauer
(74) *Attorney, Agent, or Firm* — Cantor Colburn LLP

(57) ABSTRACT

A lubricant separator includes a shell, a vapor inlet located at a first end of the shell to admit a flow of refrigerant and lubricant into the lubricant separator and a muffler positioned in the shell. The muffler includes a first perforated pipe extending along a longitudinal axis of the shell from the vapor inlet, a second perforated pipe radially spaced from the first perforated pipe, an absorption material layer positioned radially outboard of the second perforated pipe, and a lubricant-permeable liner positioned radially between the second perforated pipe and the absorption material layer. The lubricant-permeable liner allows for acoustic wave transmission from the second perforated pipe to the absorption material layer.

18 Claims, 4 Drawing Sheets

(56) References Cited

U.S. PATENT DOCUMENTS

| | | | |
|---|---|---|---|
| 5,350,888 | A | 9/1994 | Sager, Jr. et al. |
| 5,784,784 | A | 7/1998 | Flanigan et al. |
| 6,488,488 | B2 | 12/2002 | Achtelik et al. |
| 6,799,657 | B2 | 10/2004 | Daniels |
| 6,976,833 | B2 | 12/2005 | Daniels et al. |
| 7,100,737 | B2 | 9/2006 | Sishtla |
| 7,121,814 | B2 | 10/2006 | Rockwell et al. |
| 7,988,427 | B2 | 8/2011 | Patrick |
| 7,993,112 | B2 | 8/2011 | Rockwell |
| 8,142,172 | B2 | 3/2012 | Forster |
| 8,328,532 | B2 | 12/2012 | Sishtla |
| 8,500,424 | B2 | 8/2013 | Feller et al. |
| 2010/0209280 | A1 | 8/2010 | Flannigan et al. |
| 2015/0004015 | A1 | 1/2015 | Kienzle et al. |

FOREIGN PATENT DOCUMENTS

| | | | |
|---|---|---|---|
| EP | 1702163 | B1 | 6/2011 |
| WO | 2006130131 | A1 | 12/2006 |
| WO | 2009009728 | A2 | 1/2009 |

OTHER PUBLICATIONS

Written Opinion for International Application No. PCT/IB2016/001782; International Filing Date Nov. 15, 2016; dated Jul. 18, 2017; 7 Pages.

* cited by examiner

MUFFLER FOR LUBRICANT SEPARATOR

CROSS REFERENCE TO RELATED APPLICATIONS

This preliminary amendment is submitted with the application for entry into the U.S. National Phase. This application is based on PCT/IB2016/001782, filed Nov. 15, 2016, which is incorporated herein by reference in its entirety.

BACKGROUND

The subject matter disclosed herein relates to heating, ventilation, air conditioning and refrigeration (HVAC&R) systems. More specifically, the subject matter disclosed herein relates to compressor oil recovery for HVAC&R systems.

Refrigeration systems typically include a compressor delivering compressed refrigerant to a condenser. From the condenser, the refrigerant travels to an expansion valve, and then to an evaporator. From the evaporator, the refrigerant returns to the compressor to be compressed.

The compressor is typically provided with lubricant, such as oil, which is used to lubricate bearing and other running surfaces of the compressor. During operation of the compressor, the lubricant mixes with the refrigerant operated on by the compressor, such that an oil/refrigerant mixture leaves the compressor and flows through the refrigerant system. This is undesirable, as the mixing of oil with the refrigerant flowing through the system makes it difficult to maintain an adequate supply of oil at the compressor for lubrication of the compressor surfaces. Oil separators are typically utilized to separate oil from the refrigerant and oil mixture to return to the compressor. Mufflers are utilized at the oil separator in an attempt to reduce the effects of pulsation of fluid flow into the oil separator, such as vibration and noise. Current mufflers are designed for systems in which compressors are fixed speed and are thus not effective when paired with compressors operating at variable speeds.

BRIEF SUMMARY

In one embodiment, a lubricant separator includes a shell, a vapor inlet located at a first end of the shell to admit a flow of refrigerant and lubricant into the lubricant separator and a muffler positioned in the shell. The muffler includes a first perforated pipe extending along a longitudinal axis of the shell from the vapor inlet, a second perforated pipe radially spaced from the first perforated pipe, an absorption material layer positioned radially outboard of the second perforated pipe, and a lubricant-permeable liner positioned radially between the second perforated pipe and the absorption material layer. The lubricant-permeable liner allows for acoustic wave transmission from the second perforated pipe to the absorption material layer.

Additionally or alternatively, in this or other embodiments one or more baffles extend radially outwardly from the first perforated pipe to position the absorption material layer.

Additionally or alternatively, in this or other embodiments an intermediate pathway defined between the first perforated pipe and the second perforated pipe is free from absorption material.

Additionally or alternatively, in this or other embodiments the absorption material layer substantially fills an outer pathway defined between the liner and the shell.

Additionally or alternatively, in this or other embodiments the absorption material layer is formed from one or more of fiberglass or rockwool.

Additionally or alternatively, in this or other embodiments the liner is formed from one or more of steel woven cloth.

Additionally or alternatively, in this or other embodiments a gas outlet is located at a second end of the shell opposite the first end to discharge a flow of refrigerant from the lubricant separator.

Additionally or alternatively, in this or other embodiments a lubricant outlet is located in the shell to discharge a flow of lubricant from the lubricant separator.

In another embodiment, a heating, ventilation, air conditioning and refrigeration system includes a compressor configured to compress a flow of refrigerant therethrough, a condenser fluidly coupled to the compressor to receive the flow of refrigerant from the compressor, and a lubricant separator configured to separate a compressor lubricant from the flow of refrigerant. The lubricant separator includes a shell, a vapor inlet located at a first end of the shell to admit a flow of refrigerant and lubricant into the lubricant separator, and a muffler positioned in the shell. The muffler includes a first perforated pipe extending along a longitudinal axis of the shell from the vapor inlet, a second perforated pipe radially spaced from the first perforated pipe, an absorption material layer positioned radially outboard of the second perforated pipe, and a lubricant-permeable liner disposed radially between the second perforated pipe and the absorption material layer, the lubricant-permeable liner allowing for acoustic wave transmission from the second perforated pipe to the absorption material layer.

Additionally or alternatively, in this or other embodiments one or more baffles extend radially outwardly from the first perforated pipe, the one or more baffles positioning the absorption material layer.

Additionally or alternatively, in this or other embodiments an intermediate pathway defined between the first perforated pipe and the second perforated pipe is free from absorption material.

Additionally or alternatively, in this or other embodiments the absorption material layer substantially fills an outer pathway defined between the liner and the shell.

Additionally or alternatively, in this or other embodiments the absorption material layer is formed from one or more of fiberglass or rockwool.

Additionally or alternatively, in this or other embodiments the liner is formed from one or more of steel woven cloth.

Additionally or alternatively, in this or other embodiments a gas outlet is located at a second end of the shell opposite the first end to discharge a flow of refrigerant from the lubricant separator.

Additionally or alternatively, in this or other embodiments a lubricant outlet is located in the shell to discharge a flow of lubricant from the lubricant separator.

Additionally or alternatively, in this or other embodiments the lubricant separator is positioned along a refrigerant line extending between the compressor and the condenser.

Additionally or alternatively, in this or other embodiments the compressor is a variable speed screw compressor.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
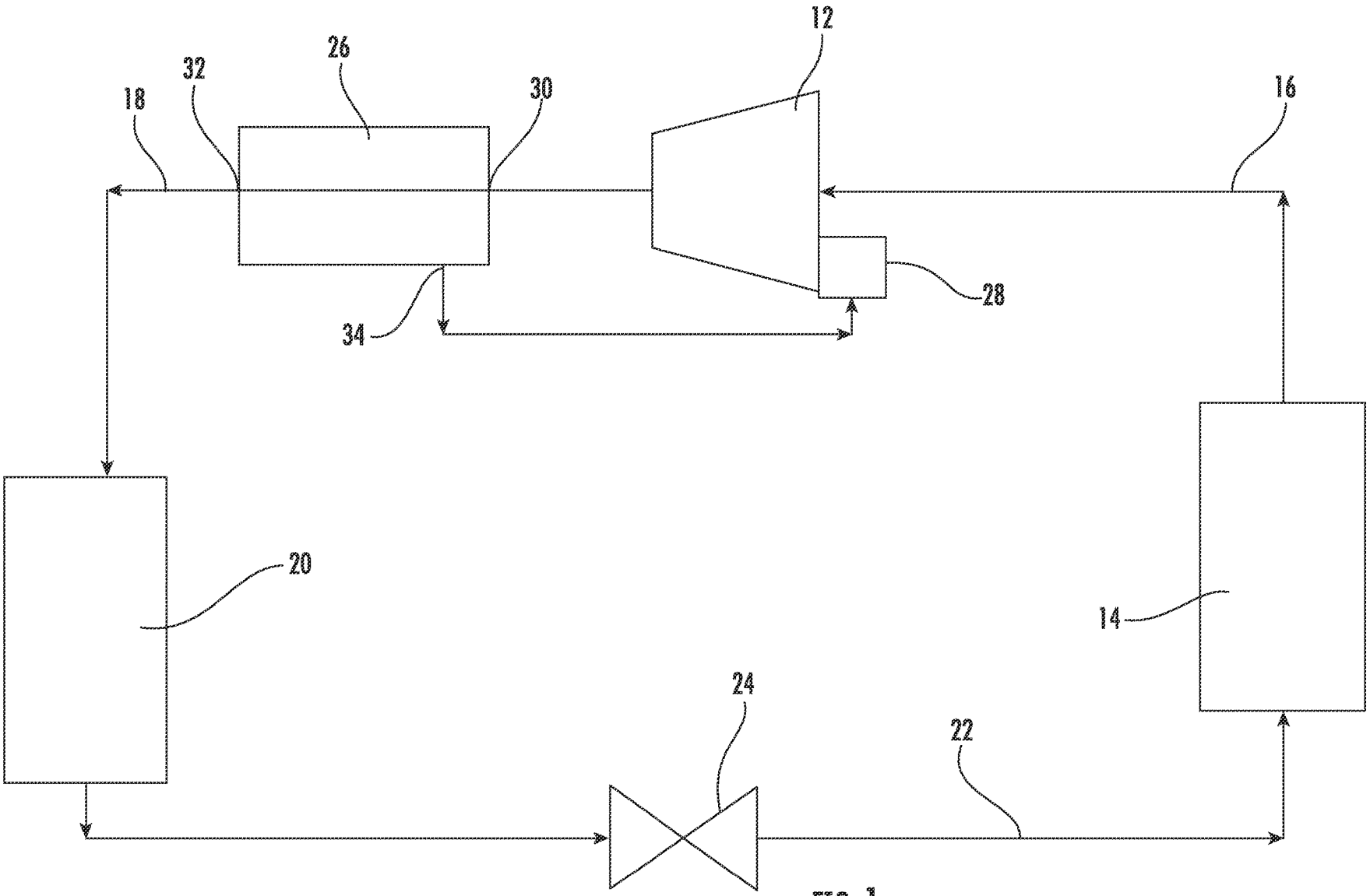
FIG. 1 is a schematic view of an embodiment of a heating, ventilation, air conditioning and refrigeration system.

Shown in FIG. 1 is a schematic of an embodiment of a refrigerant system 10. The refrigerant system 10 includes a compressor 12. The present disclosure provides particular benefit for screw compressors, but this disclosure is also beneficial to refrigerant systems 10 having other types of compressors 12. An evaporator 14, in some embodiments a flooded style evaporator 14, delivers a flow of refrigerant to the compressor 12 through a suction line 16. From the compressor 12, the refrigerant flows through discharge line 18 to a condenser 20. Compressed, gaseous refrigerant is cooled in the condenser 20, transferred into a liquid phase, and passed through an expansion valve 24 on its way to the evaporator 14 through conduit 22. At the evaporator 14, an environment to be cooled, such as a fluid flowing through a plurality of evaporator tubes (not shown), is cooled by the refrigerant at the evaporator 14.

Lubricant, usually oil, is supplied to the compressor 12 to lubricate bearings and other running surfaces of the compressor 12. During operation of the system 10, the oil mixes with the refrigerant operated on by the compressor 12, such that the refrigerant flowing through the system 10 may include a volume of oil entrained therein. To avoid depletion of the supply of oil for lubricating the compressor 12, and to reduce adverse system performance effects of the oil mixed with the refrigerant, the system 10 includes an oil separator 26 located, for example, between the compressor 12 and the condenser 20 along line 18. The oil separator 26 receives a compressed refrigerant gas and oil entrained therein from the compressor 12 and separates the refrigerant from the oil via, for example, distillation or some other process. Gaseous refrigerant is expelled from the oil separator 26 toward the condenser 20 along line 18, while the oil is directed to an oil sump 28 at the compressor 12 for use in lubrication of the running surfaces of the compressor 12.

Figure 2:
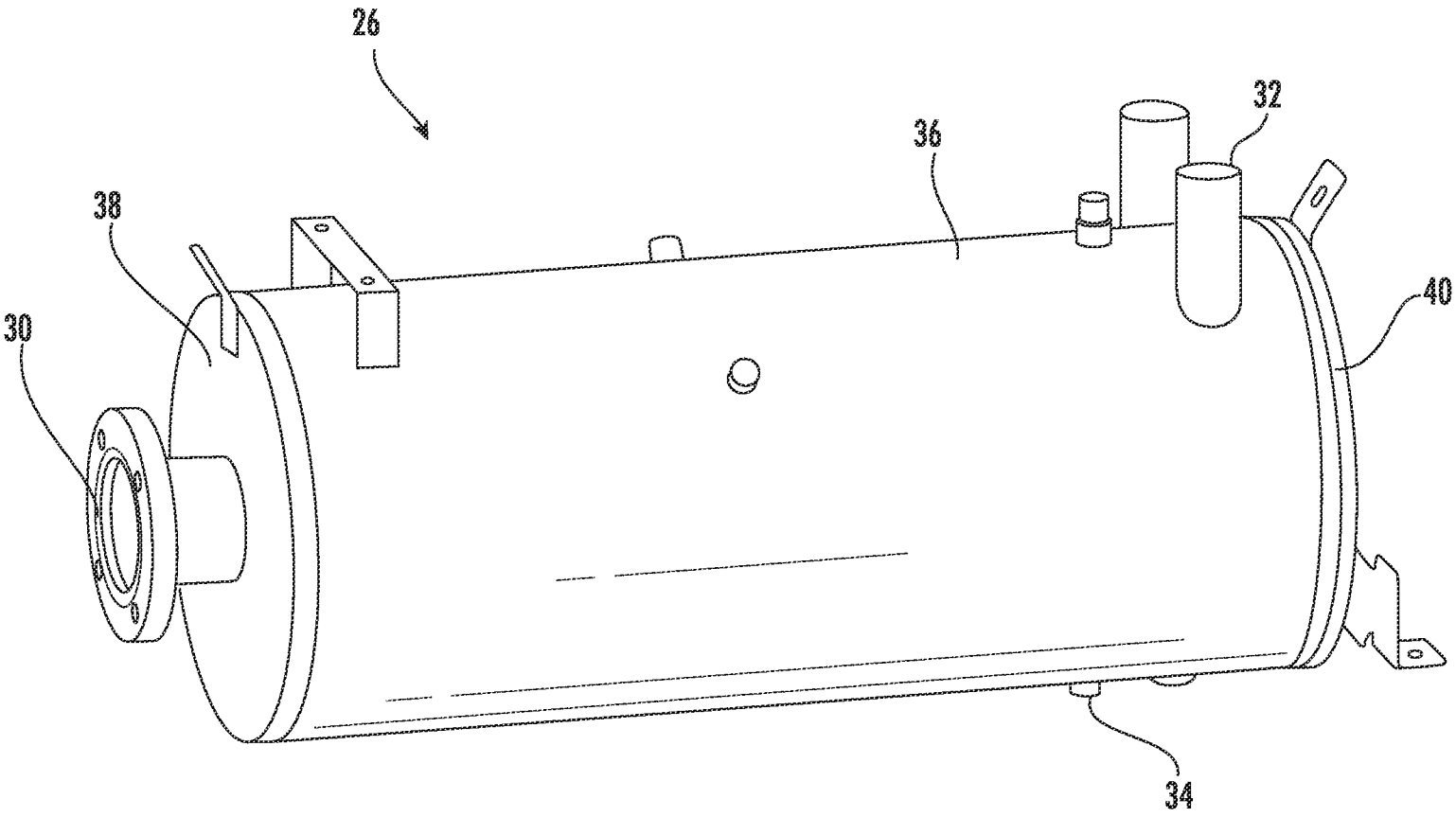
FIG. 2 is a schematic view of an embodiment of a lubricant separator for a heating, ventilation, air conditioning and refrigeration system.

Referring now to FIG. 2, an embodiment of an oil separator 26 is illustrated. In some embodiments, the oil separator 26 is configured as a horizontal oil separator. The oil separator 26 has a vapor inlet 30 through which the refrigerant and oil mixture enters the oil separator 26, and also a gas outlet 32 at which the gaseous refrigerant leaves the oil separator 26 and is directed to the condenser 20. The oil separator 26 also includes an oil outlet 34 through which liquid oil is returned to the oil sump 28. The components of the oil separator 26 are contained in a separator shell 36, which in some embodiments is cylindrical in shape. In some embodiments, the vapor inlet 30 is located at an inlet plate 38 while the gas outlet 32 is located at or near a second plate 40. In some embodiments, the gas outlet 32 is located nearer the second plate 40 to the inlet plate 38.

Figure 3:
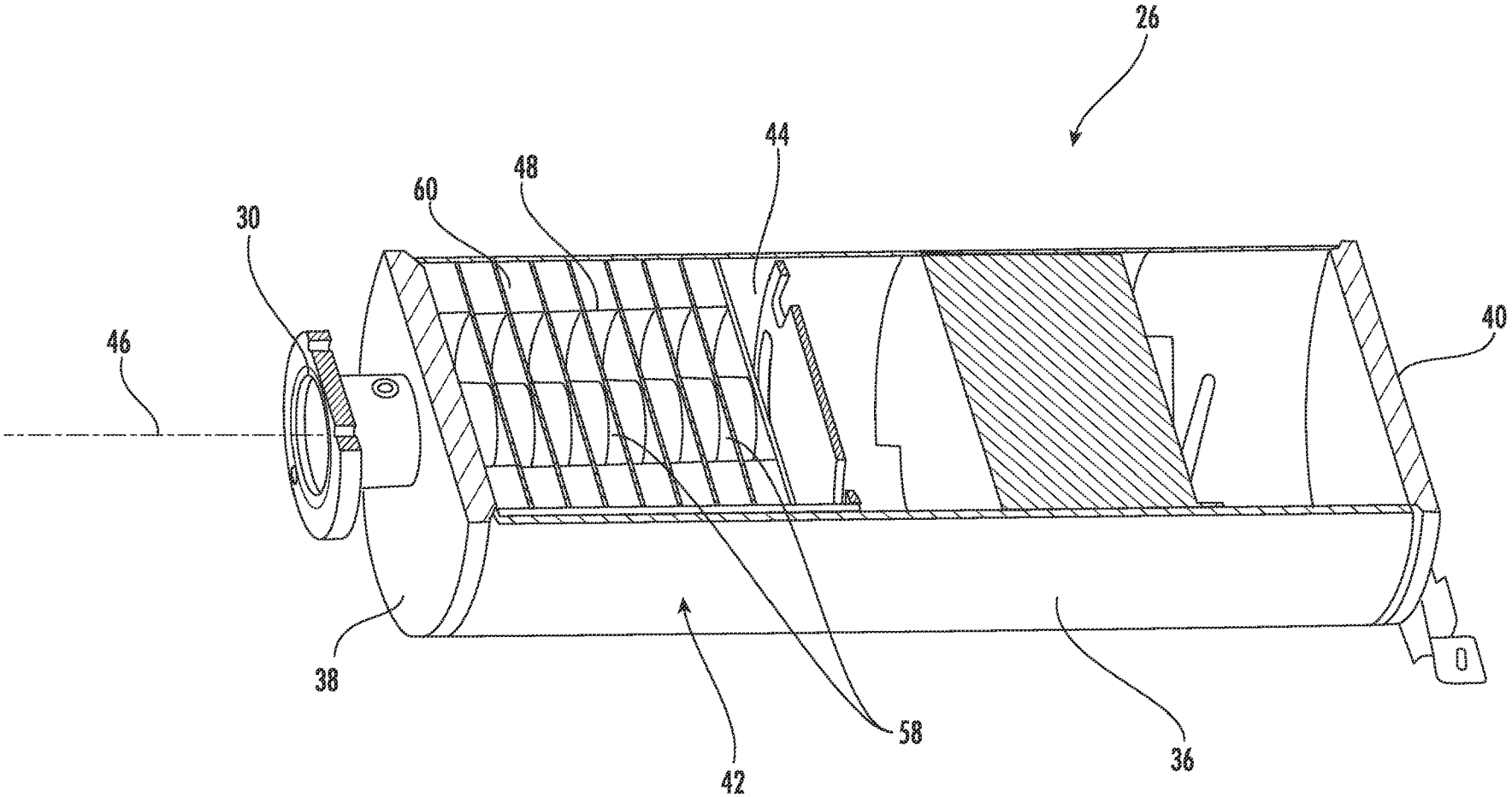
FIG. 3 is a cross-sectional view of an embodiment of a lubricant separator for a heating, ventilation, air conditioning and refrigeration system.

Referring now to the cross-sectional view of FIG. 3, a muffler 42 is positioned in the oil separator 26. The muffler 42 is positioned inside the separator shell 36 at or near the vapor inlet 30, coming from the compressor 12 through a compressor discharge line, to reduce pulsations in the refrigerant and oil mixture. The muffler 42 includes a first perforated pipe 44 extending along a separator central axis 46. A second perforated pipe 48 is concentric with the first perforated pipe 44 and radially spaced therefrom. The first perforated pipe 44 and the second perforated pipe 48 each have a plurality of openings (not shown) therein to allow fluid communication between an internal pathway 52 inside the first perforated pipe 44, an intermediate pathway 54 between the first perforated pipe 44 and the second perforated pipe 48, and an external pathway 56 outside of the second perforated pipe 48.

In some embodiments, one or more baffles 58 are located along the separator central axis 46, to aid in reducing the effects of fluid pulsation entering the oil separator 26. In some embodiments, the one or more baffles 58 extend radially outwardly from the first perforated pipe 44 to the second perforated pipe 48, with the first perforated pipe 44 defining an inboard radial extent of the one or more baffles 58. Further, the one or more baffles 58 extend to the separator shell 36, with the separator shell 36 defining an outboard radial extent of the one or more baffles 58.

Figure 4:
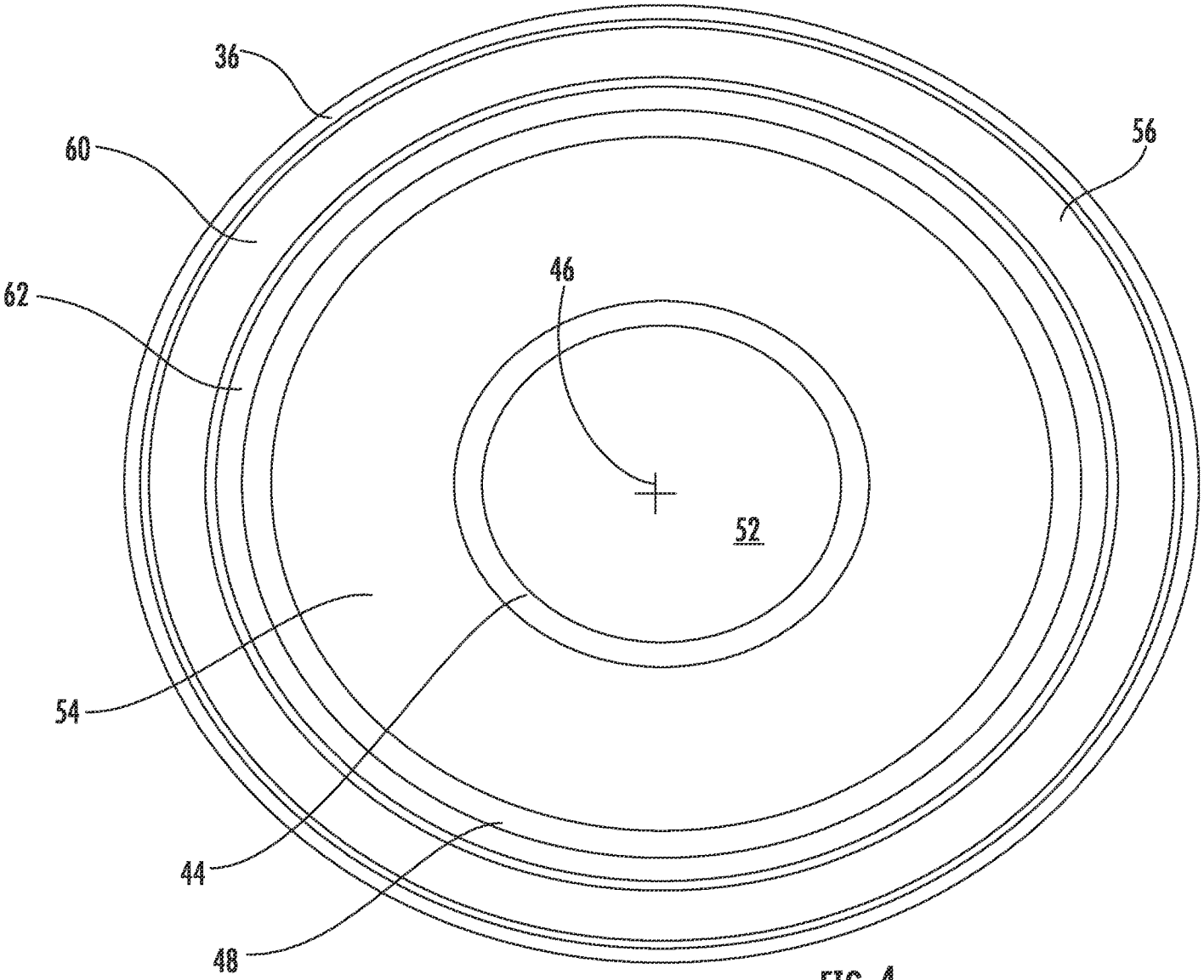
FIG. 4 is cross-sectional view of an embodiment of two layer muffler used in the lubricant separator for a heating, ventilation, air conditioning and refrigeration system.

Referring now to the cross-sectional view of FIG. 4, while the internal pathway 52 is empty space as constructed, and the one or more baffles 58 occupy the intermediate pathway 54, an absorption material layer 60 is located radially outboard of the second perforated pipe 48, between baffles 58 of the one or more baffles 58. In some embodiments, the absorption material layer 60 is rockwool or fiberglass to absorb pulsation acoustic soundwaves. In some embodiments, the absorption material layer 60 occupies or fills the external pathway 56 in its entirety. Further, a liner 62 is located between the second perforated pipe 48 and the absorption material layer 60. In some embodiments, the liner 62 is formed from steel woven cloth, which allows the acoustic waves to propagate through the open construction of the liner 62 to be absorbed by the absorption material layer 60, even when the liner 62 is saturated with refrigerant and/or oil during operation of the oil separator 26.

The muffler 42 including the one or more baffles 58, and the liner 62 of the present disclosure results in a muffler 42 meeting desired performance standards for reducing compressor discharge pulsation across a wide range of operating frequencies, such as 25 Hz to 100 Hz, making the muffler 42 useful for and compatible with variable speed compressors 12, rather than merely compatible with a fixed-speed compressor, such as prior mufflers. Further, the liner 62 has improved transmission loss performance, compared to prior mufflers, when soaked with refrigerant and/or oil during operation of the oil separator 36. Also, the reactive function in muffler 42 applies the designed volumes between the first perforated pipe 44 and the second perorated pipe 48 to lower dynamic pressure when absorption material layer 60 soaked with refrigerant and/or oil. Further still, the muffler 42 achieves the improved performance while being integrated into the oil separator 36 and not increasing a footprint or volume occupied by the oil separator 36 and muffler 42 combination.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A lubricant separator comprising:

a shell;

a vapor inlet disposed at a first end of the shell to admit a flow of refrigerant and lubricant into the lubricant separator;

a muffler disposed in the shell, the muffler including:

a first perforated pipe extending along a longitudinal axis of the shell from the vapor inlet;

a second perforated pipe radially spaced from the first perforated pipe;

an absorption material layer disposed radially outboard of the second perforated pipe; and a lubricant-permeable liner disposed radially between the second perforated pipe and the absorption material layer, the lubricant-permeable liner allowing for acoustic wave transmission from the second perforated pipe to the absorption material layer.

2. The lubricant separator of claim 1, further comprising one or more baffles extending radially outwardly from the first perforated pipe, the one or more baffles positioning the absorption material layer.

3. The lubricant separator of claim 1, wherein an intermediate pathway defined between the first perforated pipe and the second perforated pipe is free from absorption material.

4. The lubricant separator of claim 1, wherein the absorption material layer substantially fills an outer pathway defined between the liner and the shell.

5. The lubricant separator of claim 1, wherein the absorption material layer is formed from one or more of fiberglass or rockwool.

6. The lubricant separator of claim 1, wherein the liner is formed from one or more of steel woven cloth.

7. The lubricant separator of claim 1, further comprising a gas outlet disposed at a second end of the shell opposite the first end to discharge a flow of refrigerant from the lubricant separator.

8. The lubricant separator of claim 1, further comprising a lubricant outlet disposed in the shell to discharge a flow of lubricant from the lubricant separator.

9. A heating, ventilation, air conditioning and refrigeration system, comprising:

a compressor configured to compress a flow of refrigerant therethrough;

a condenser fluidly coupled to the compressor to receive the flow of refrigerant from the compressor;

a lubricant separator configured to separate a compressor lubricant from the flow of refrigerant, the lubricant separator including:

a shell;

a vapor inlet disposed at a first end of the shell to admit a flow of refrigerant and lubricant into the lubricant separator;

a muffler disposed in the shell, the muffler including:

a first perforated pipe extending along a longitudinal axis of the shell from the vapor inlet;

a second perforated pipe radially spaced from the first perforated pipe;

an absorption material layer disposed radially outboard of the second perforated pipe; and a lubricant-permeable liner disposed radially between the second perforated pipe and the absorption material layer, the lubricant-permeable liner allowing for acoustic wave transmission from the second perforated pipe to the absorption material layer.

10. The heating, ventilation, air conditioning and refrigeration system of claim 9, further comprising one or more baffles extending radially outwardly from the first perforated pipe, the one or more baffles positioning the absorption material layer.

11. The heating, ventilation, air conditioning and refrigeration system of claim 9, wherein an intermediate pathway defined between the first perforated pipe and the second perforated pipe is free from absorption material.

12. The heating, ventilation, air conditioning and refrigeration system of claim 9, wherein the absorption material layer substantially fills an outer pathway defined between the liner and the shell.

13. The heating, ventilation, air conditioning and refrigeration system of claim 9, wherein the absorption material layer is formed from one or more of fiberglass or rockwool.

14. The heating, ventilation, air conditioning and refrigeration system of claim 9, wherein the liner is formed from one or more of steel woven cloth.

15. The heating, ventilation, air conditioning and refrigeration system of claim 9, further comprising a gas outlet disposed at a second end of the shell opposite the first end to discharge a flow of refrigerant from the lubricant separator.

16. The heating, ventilation, air conditioning and refrigeration system of claim 9, further comprising a lubricant outlet disposed in the shell to discharge a flow of lubricant from the lubricant separator.

17. The heating, ventilation, air conditioning and refrigeration system of claim 9, wherein the lubricant separator is disposed along a refrigerant line extending between the compressor and the condenser.

18. The heating, ventilation, air conditioning and refrigeration system of claim 9 wherein the compressor is a variable speed screw compressor.

* * * * *